US009566632B1

(12) United States Patent
Meldahl et al.

(10) Patent No.: US 9,566,632 B1
(45) Date of Patent: Feb. 14, 2017

(54) SHAPING TOOL DIE

(71) Applicant: Con-Tech Manufacturing Inc., Dodge Center, MN (US)

(72) Inventors: Brian R. Meldahl, Brownsdale, MN (US); Garwin B. McNeilus, Dodge Center, MN (US)

(73) Assignee: CON-TECH MANUFACTURING, INC., Dodge Center, MN (US)

( * ) Notice: Subject to any disclaimer, the term of this patent is extended or adjusted under 35 U.S.C. 154(b) by 0 days.

(21) Appl. No.: 14/847,369

(22) Filed: Sep. 8, 2015

(51) Int. Cl.
*B21D 37/02* (2006.01)
*B21D 5/02* (2006.01)

(52) U.S. Cl.
CPC ..... *B21D 37/02* (2013.01); *B21D 5/02* (2013.01)

(58) Field of Classification Search
CPC ..... B21D 37/02; B21D 5/02
USPC ..... 72/413, 478
See application file for complete search history.

(56) References Cited

U.S. PATENT DOCUMENTS 2,267,774 A * 12/1941 Wall ..... B21C 37/28 72/466.9
2,966,934 A * 1/1961 Huet ..... B21D 7/06 72/386
3,474,657 A * 10/1969 Spiegel ..... B21D 5/0209 72/478
3,585,836 A * 6/1971 Tate et al. ..... B21D 22/02 29/896.91
3,769,704 A * 11/1973 Abarotin ..... H01R 43/042 29/517
5,878,619 A * 3/1999 Walczak ..... B21D 5/0209 72/381
6,523,389 B1 * 2/2003 Girdner ..... B21D 37/02 72/380
6,679,757 B2 1/2004 Degraaff et al.
6,782,729 B2 8/2004 Sperrer
7,324,868 B2 * 1/2008 Yamazaki ..... G05B 19/188 700/117
8,047,037 B2 11/2011 Vehof et al.

* cited by examiner

*Primary Examiner* — David B Jones
(74) *Attorney, Agent, or Firm* — Nikolai & Mersereau, P.A.; C. G. Mersereau

(57) ABSTRACT

A shaping tool die for shaping components from sheet material includes two matching shaping tool die halves, each shaping tool die half having a plurality of spaced plate die shapes, each die shape having a rotatable curved surface mated with a curved recess in the free end of a base mounting plate such that each plate die shape is separately adjustable relative to a mated mounting plate. A position fixing plate is associated with each plate die shape and base mounting plate combination to adjustably fix the position of the plate die shape relative to the base mounting plate in a desired position. A base member is provided for receiving the base mounting plates for each tool die half, and at least one clamp plate member threaded through corresponding base mounting plates of each die half and removably fixed to a corresponding base member is provided to fix the base mounting plates in place.

8 Claims, 3 Drawing Sheets

SHAPING TOOL DIE

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to a shaping tool die for shaping a component, in particular, a component fabricated from a steel sheet. More particularly, the invention relates to a shaping tool having adjustable upper and lower tool half die arrangements using a plurality of spaced adjustable die plates.

II. Related Art

It is known to use shaping tools that combine an upper shaping tool half with a corresponding lower shaping tool half which combine to shape a plate or other blank inserted and clamped therebetween. The upper and lower shaping tool halves normally have fixed shapes that are cast or forged and are limited to producing one particular shape of one particular item. One such device, which also includes a cooling aspect, is shown in U.S. Pat. No. 8,047,037 B2. A further shaping tool arrangement made up of a plurality of components assembled together is shown in U.S. Pat. No. 6,679,757 B2. While those devices have met with success, they remain limited to producing a single shape and are expensive to repair.

Accordingly, there remains a need for a shaping tool die having a shape-adjustable upper shaping tool half and shape-adjustable lower shaping tool half such that the die shape can be varied. There also remains a need for such a shaping tool that has die plates that are readily replaceable.

SUMMARY OF THE INVENTION

By means of the present invention, there is produced a shaping tool die having an upper shaping tool die half and a lower shaping tool die half that are readily adjustable to give the tool an adjustable die shape. The upper shaping tool die half and the lower shaping tool die half include a plurality of spaced plate die shapes that have a rotatable curved mounting shape that mates with the free end of a base mounting plate member having a round recess. Position fixing plates removably and adjustably fixed (preferably bolted) to the sides of each plate die shape and base mounting plate fix the position of each die shape relative to the base mounting plate at a predetermined desired position. The base mounting plates are carried by base members which are upper and lower plate members. The upper and lower base members are slotted to receive the base mounting plates in spaced fixed locations. Clamp plates threaded through the spaced base mounting plates are removably fixed to the base members and used to hold the mounting plates in the base members. They are also preferably bolted.

Each of the plurality of spaced plate die shapes can be rotated relative to its corresponding base member and the corresponding mating upper or lower plate die shape rotated to match. This enables variations in shaping along the length of a work piece. The spaced die shapes can be arranged in a straight line or in a curved or fan profile. The fan profile enables the use on curved work pieces and the addition of a twist of a formed part. The use of the plates bolted to the sides between each adjustable plate die shape and associated base mounting plate member secures a desired rotational position of the die shape which is readily adjustable.

It will be appreciated that the shaping tool of the invention may be made out of any of various materials including steel, plastic, wood or any other durable material depending on the forces needed to shape the corresponding work piece involved. The concept of bolting the parts together gives the assembly a great deal of adjustability and the freedom to replace or remove any individual plate die plates or other parts.

BRIEF DESCRIPTION OF THE DRAWINGS

In the drawings wherein like numerals depict like parts.

DETAILED DESCRIPTION

The following description details one or more exemplary embodiments illustrating the present invention. It should be noted that the detailed descriptions are intended by way of example only and are not intended to limit the scope of the invention in any respect. It will be further understood that the embodiments of the invention can be modified by those skilled in the art while remaining in keeping with the inventive concepts.

Figure 1:
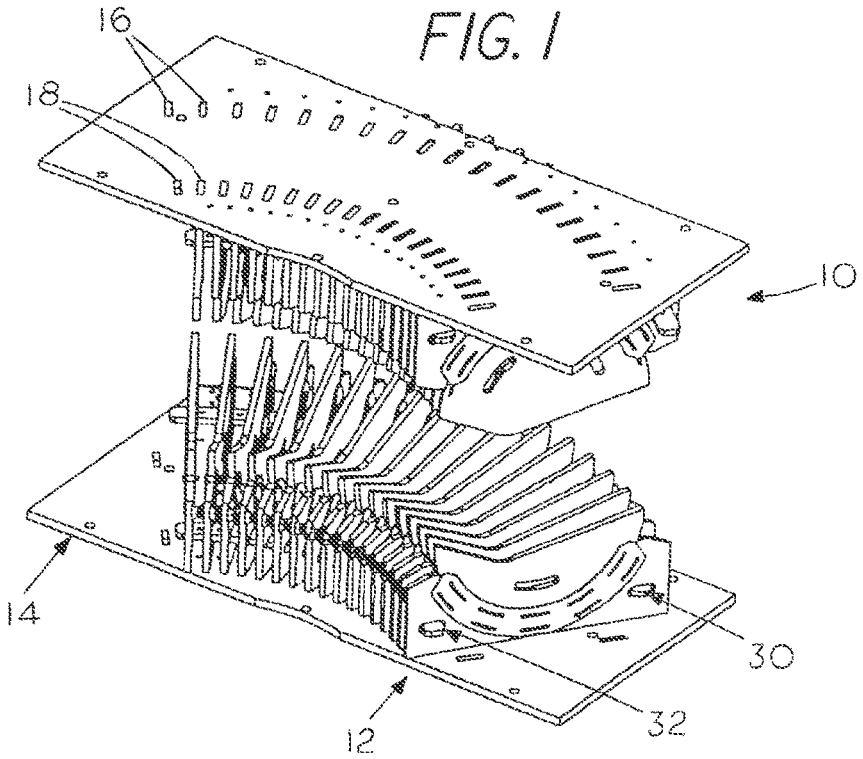
FIG. 1 is a perspective view showing spaced assembled upper and lower shaping tool halves.
Figure 2:
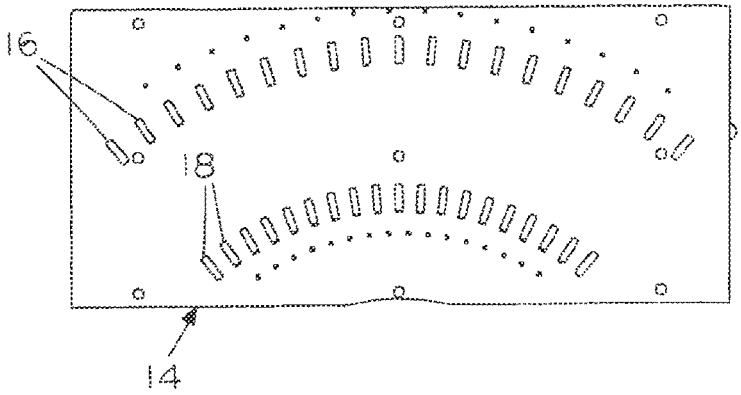
FIG. 2 depicts a base plate of FIG. 1.

FIG. 1 is a perspective view showing assembled upper and lower shaping tool die halves 10 and 12, respectively. Each shaping tool die half includes an identical opposed base plate 14 which includes a series of front and rear slots as at 16 and 18, which are designed to hold tabs of upper base mounting plates 20 and lower base mounting plates 22 in position and secure top to bottom alignment using upper base mounting plate member tabs 26 and lower base mounting plate member tabs 28, as best shown in FIGS. 5A and 6. The upper and lower base mounting plates are further secured by front and rear clamp plates as at 30 and 32 in FIG. 1, which are shaped bars that entered the length of the disc and engage openings in all of the die base mounting plates 20 and 22 through openings 34 and 36 in the upper tool half and 38 and 40 in the lower tool half. The clamp plates are bolted to the respective base plates 14 thereby fixing the upper and lower base mounting plates in place.

Figure 5B:
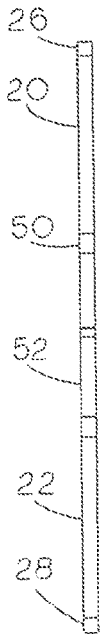
FIG. 5B is an end elevational view of the assembly of FIG. 5A.
Figure 5A:
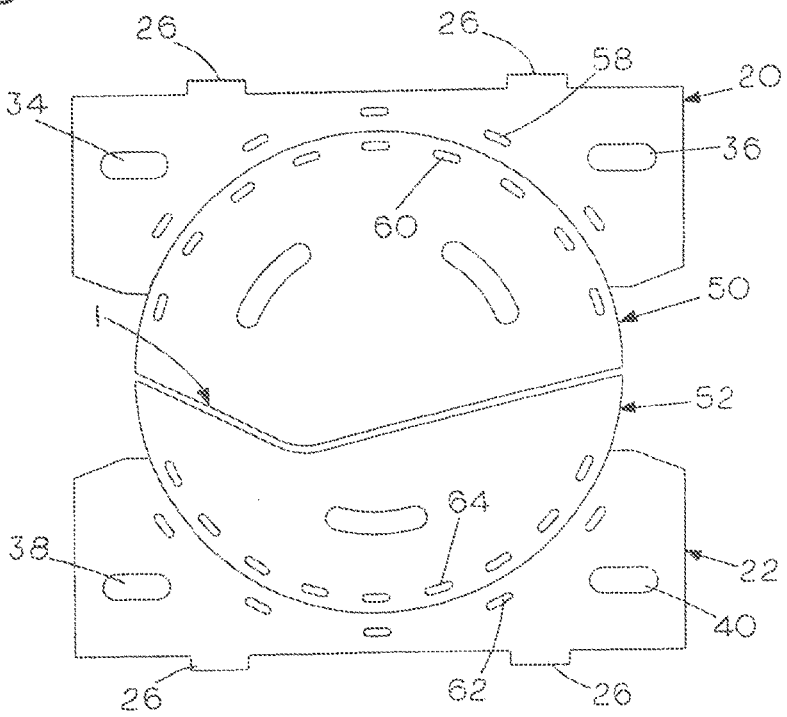
FIG. 5A is a side elevational view of a set of corresponding mated upper and lower plate die shapes assembled in respective base mounting plates.
Figure 6:
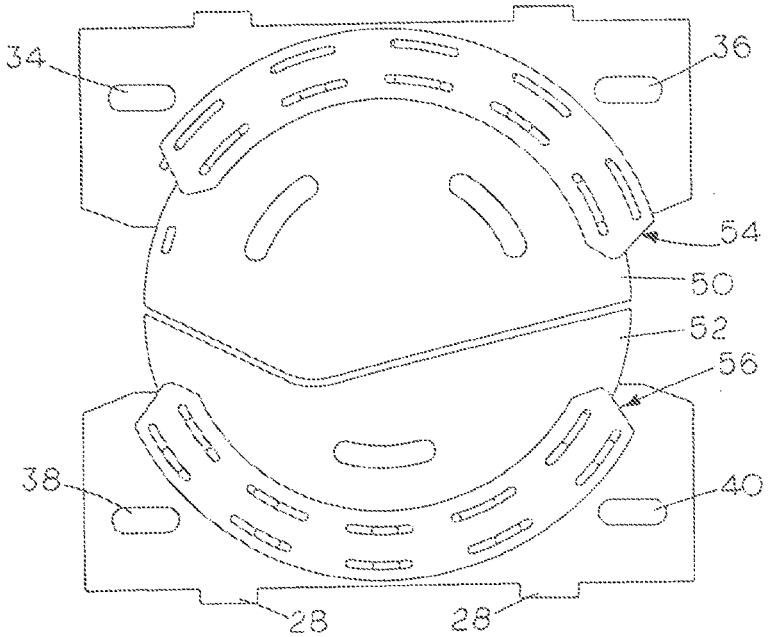
FIG. 6 is a view similar to FIG. 5A with securing upper and lower side plates.

As best seen in FIGS. 5A, 5B and 6, each upper shaping tool half includes an associated upper plate die shape which nests in a corresponding upper base mounting plate member 20 and is able to rotate with respect to the mounting plate as the interface is a circle segment. In the same manner, each lower shaping tool half includes an associated lower plate die shape 52 which nests in a corresponding lower base mounting plate 22 and is able to rotate in the same manner. As shown in FIG. 6, the position of the upper die plate shapes 50 and the lower die plate shapes 52, once adjusted, are fixed in place by plates 54 and 56 which may be bolted between openings 58 in series in upper base mounting plates 20 and openings 60 in upper plate die shapes 50. The lower plate die shapes are fixed in place in the same manner using openings 62 and 64.

The detailed description shows a particular die shape bend but it will be appreciated that the die shape can vary to any configuration and the radius of the associated die plates and mounting plates may also vary depending on the size and desired formed shape of the part or work piece formed. Also, adjacent die shapes may have different rotational positions to add a twist or different curvature. Also, the series of die shapes are shown in an arcuate or fan-shaped pattern, however, the shape may be straight or in some other configuration.

Figure 3:
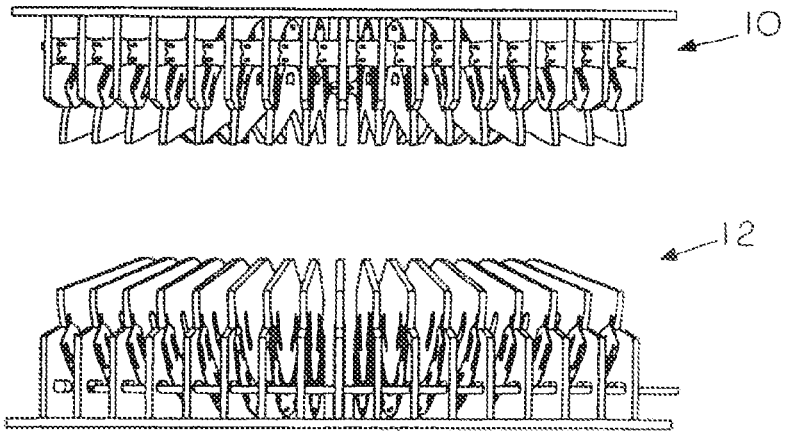
FIG. 3 is a front elevational view of spaced upper and lower shaping tool halves.
Figure 4:
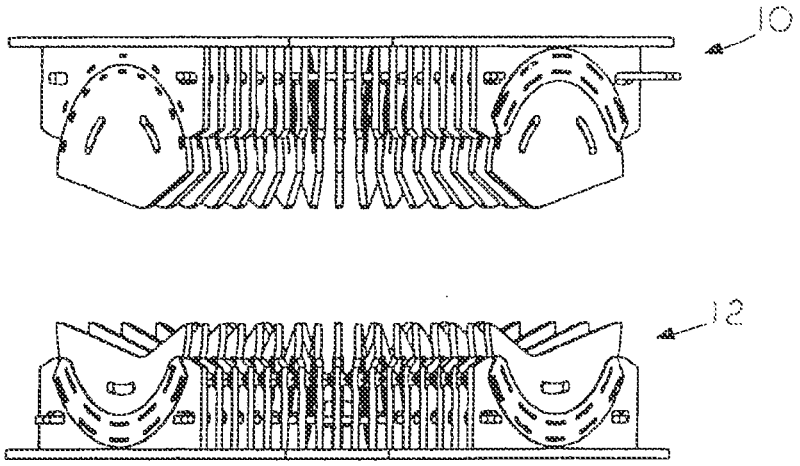
FIG. 4 is a rear elevational view of spaced upper and lower shaping tool halves.

FIGS. 3 and 4 show front and rear elevational views of spaced upper and lower shaping tool die halves of the embodiment of FIG. 1.

It will be appreciated that the shaping tool of the invention may be made out of any of various materials including steel, plastic, wood or any other durable material depending on the forces needed to shape the corresponding work piece involved. The concept of bolting the parts together gives the assembly a great deal of adjustability and the freedom to replace or remove any individual die plates. This clearly is not possible with common welded structures and also avoids the possibility of parts being warped from the heat of the welding process.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A shaping tool die for shaping components from sheet material comprising:

(a) two matching shaping tool die halves;

(b) each shaping tool die half comprising a plurality of spaced plate die shapes and a plurality of base mounting plates, each plate die shape having a rotatable curved surface mated with a curved recess in a free end of a corresponding base mounting plate such that each plate die shape is separately adjustable relative to the corresponding base mounting plate;

(c) a position fixing plate associated with each plate die shape and base mounting plate combination to adjustably fix the position of the plate die shape relative to the base mounting plate;

(d) a base member for receiving the base mounting plates for each tool die half; and (e) at least one clamp plate member threaded through the base mounting plates of each die half and removably fixed to a corresponding base member to fix the base mounting plates in place.

2. A shaping tool die as in claim 1 wherein the plurality of spaced plate die shapes of each die half is arranged in a curved profile.

3. A shaping tool die as in claim 1 wherein each die half includes two clamp plate members.

4. A shaping tool die as in claim 1 wherein the shaping tool die is made of steel.

5. A shaping tool die as in claim 1 wherein parts are bolted together.

6. A shaping tool die as in claim 4 wherein parts are bolted together.

7. A shaping tool die as in claim 1 wherein at least some parts are made of a plastic material.

8. A shaping tool die as in claim 1 wherein at least some parts are made of wood.

* * * * *